United States Patent [19]

Leuchtenmüller

[11] Patent Number: 5,058,249

[45] Date of Patent: Oct. 22, 1991

[54] APPARATUS FOR NEEDLING A NONWOVEN WEB

[75] Inventor: Rudolf Leuchtenmüller, Schwertberg, Austria

[73] Assignee: Textilmaschinenfabrik Dr. Ernst Fehrer Aktiengesellschaft, Leonding, Austria

[21] Appl. No.: 553,882

[22] Filed: Jul. 16, 1990

[30] Foreign Application Priority Data

Aug. 22, 1989 [AT] Austria ..... 1982/89

[51] Int. Cl.[5] ..... D04H 18/00

[52] U.S. Cl. ..... 28/109

[58] Field of Search ..... 28/109

[56] References Cited

U.S. PATENT DOCUMENTS 3,646,781 3/1982 Scholtis et al. ..... 28/109 X

FOREIGN PATENT DOCUMENTS 183952 1/1989 European Pat. Off. .

7411919 11/1985 France ..... 28/109

7217744 5/1972 Japan ..... 28/109

7217745 5/1972 Japan ..... 28/109

*Primary Examiner*—Werner H. Schroeder

*Assistant Examiner*—John J. Calvert

*Attorney, Agent, or Firm*—Kurt Kelman

[57] ABSTRACT

It is desired to provide an apparatus for needling a nonwoven web with a brushlike pierceable support and to provide surface patterns independently of a control of the depth of penetration of the needles. To that end the bristles of the covering of bristles of the pierceable support vary in accordance with a predetermined pattern as regards the bristle spacing and/or the extent to which the bristles protrude toward the nonwoven web.

8 Claims, 1 Drawing Sheet

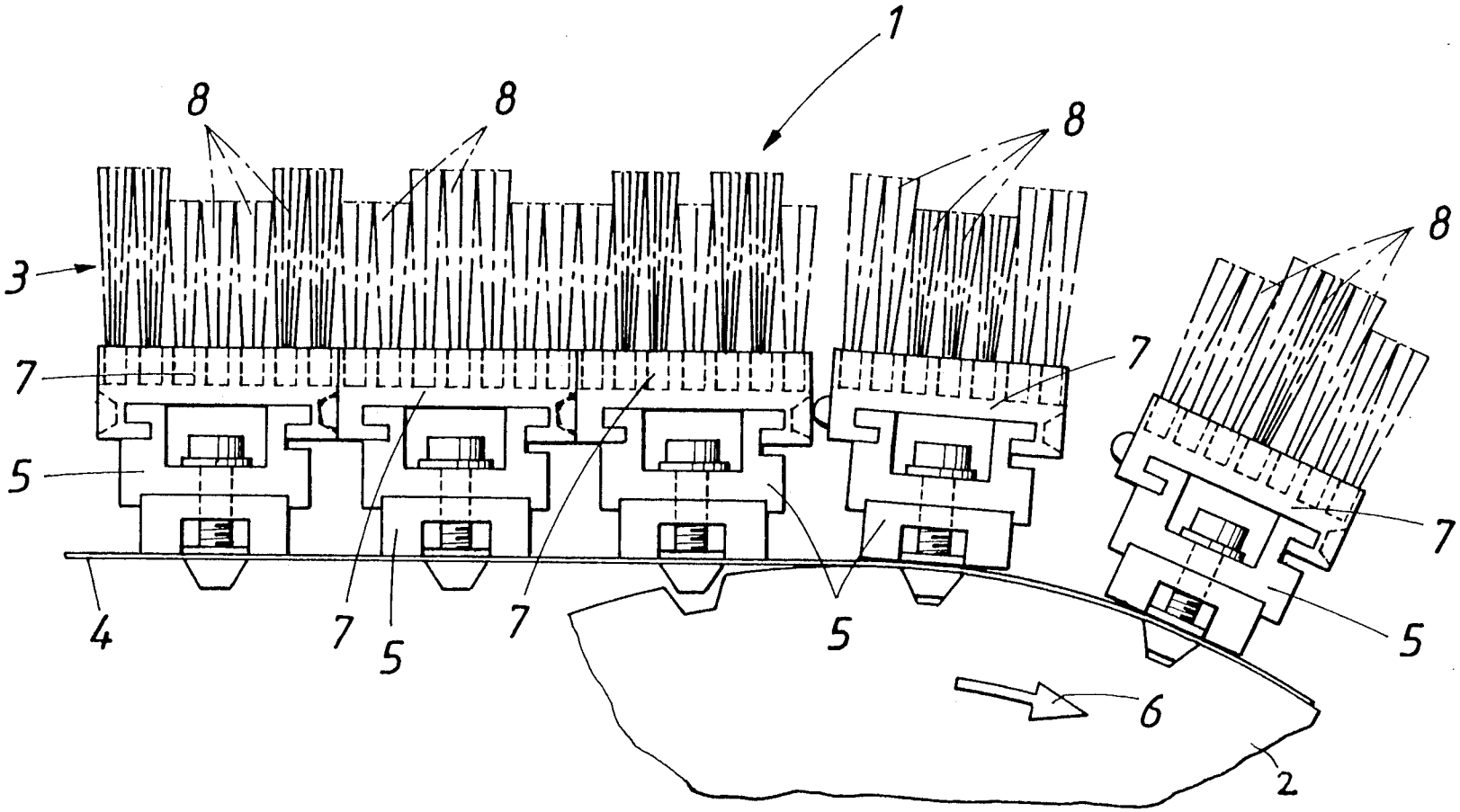
1
2
3
4
5
6
7
8

APPARATUS FOR NEEDLING A NONWOVEN WEB

BACKGROUND OF THE INVENTION

1. Field of the Invention

This invention relates to an apparatus for needling a nonwoven web comprising a brushlike pierceable support, which consists of an endless backing, which is trained around reversing pulleys and provided with a covering of bristles.

2. Description of the Prior Art

When it is desired so to needle a nonwoven web that it is provided with a structural surface or a surface pattern, it is usual to vary the depth to which the needles penetrate into the nonwoven web so that fiber loops differing in length are drawn in dependence on the varying depth of penetration and said fiber loops will then determine the surface texture of the nonwoven web. The depth of penetration may be controlled by an adjustment of the midstroke position of the needles relative to the support for the nonwoven web or by a vertical adjustment of the support for the nonwoven web. But the adjustment of the depth of penetration of the needles will substantially increase the structural expenditure, particularly if the needles reciprocate at a high frequency, and the control of the depth of penetration permits a variation of patterns only to a retricted degree.

For a production of structured velour needle felts it is known to provide a brushlike pierceable support rather than performed plates (EP-A-183 952). Said pierceable support comprises an endless backing, which is trained around reversing pulleys and provided with a covering of bristles, which can be pierced by the needles independently of a pattern of holes and is moved in unison with the nonwoven web so that a restraint as may occur adjacent to the holes of perforated plates will be avoided. But said known brushlike pierceable supports are to be used to make a fabric which has an appearance that is as uniform as possible and is free of an orientation as far as possible.

SUMMARY OF THE INVENTION

For this reason it is an object of the invention to provide a needling apparatus which permits a provision of predeterminable surface patterns independently of the depth of penetration of the needles.

In a needling apparatus of the kind described first hereinbefore the object set forth is accomplished in accordance with the invention in that the bristles of the covering of bristles have a varying spacing or have different characteristics in accordance with a predetermined pattern.

Because the formation of loops on the side on which the needle points emerge from the nonwoven web will depend on the resistance by which the covering of bristles of the brushlike pierceable support oppose the penetration of the loop-pulling needle points, that resistance to penetration may be controlled so that a surface pattern will be obtained on that side of the nonwoven web which faces the pierceable support if the conditions encountered in the covering of bristles by the loop-forming needle points are suddenly or continuously changed in accordance with a predetermined pattern and in dependence on the nature of the pattern. The conditions encountered by the loop-forming needle points as they enter the convering of bristles will be determined by the spacing of the bristles and by the characteristics of the bristles so that the bristle spacing and/or the shape of the bristles can be varied in order to produce a surface pattern. As regards the characteristics of the bristles it is possible to provide various surface structures if the geometric configuration of the bristle ends which protrude toward the nonwoven web or the material of the bristles are properly chosen. A particularly effective influence can be exerted if the extent to which the bristles protrude toward nonwoven web is varied, as will usually be achieved by the provision of bristles which differ in length or, if the bristles are equal in length, by the provision of a suitably profiled backing for the covering of bristles.

It is apparent that a great variety of surface patterns can easily be obtained by a variation of the covering of bristles of the pierceable support as regards the bristle spacing and/or the bristle characteristics whereas the depth of penetration of the needles need not be varied. It will be understood that the variation of the covering of bristles for providing a predetermined pattern may be combined with a control of the depth of penetration of the needles so that the variety of patterns which can be obtained can be increased further.

BRIEF DESCRIPTION OF THE DRAWING

The drawing is a fragmentary diagrammatic side elevation showing a pierceable support of a needling apparatus in accordance with the invention.

DETAILED DESCRIPTION OF THE PREFERRED EMBODIMENT

The needling apparatus is conventional, and for this reason is not shown, with the exception of its pierceable support 1, which essentially consists of an endless backing, which is trained around reversing pulleys 2 and provided with a covering of bristles 3 for supporting a nonwoven web. The backing is constituted by a traction element 4 and by brush bodies 7, which are secured to said traction element 4 by holders 5 and are closely spaced apart in the direction 6 in which said backing revolves. The brush bodies 7 carry the covering of bristles 3, which covering consists of individual tufts 8, as is indicated in phantom in the drawing.

Conventional brushlike pierceable supports are desirably provided with a covering of bristles which is as uniform as possible. On the other hand, the covering of bristles 3 of the pierceable support 1 in accordance with the invention varies in a predetermined pattern so that a nonwoven web lying on that pierceable support 1 can be provided with a corresponding surface pattern by a needling of that web. To that end the tufts 8 may differ in length or in the number of bristles or in their geometric configuration, particularly at the bristle ends and/or in the characteristics of their materials. Each tuft 8 will usually consist of identical bristles. But in special cases it may be desirable to vary the bristles even within a tuft. Such different tufts 8 which will form a specific surface pattern on a nonwoven web which has been needled are represented in the drawing as having different lengths and different numbers of bristles. It will obviously be possible to omit individual tufts within the covering of bristles if this is called for by the surface pattern that is to be provided.

It is apparent that the covering of bristles 3 protrudes outwardly on the outside of the backing of the pierceable support 1 and that the covering of bristles 3 varies in a pattern in at least one of the characteristics which consist of the bristle spacing, the bristle characteristics and the elevation to which the bristles extend. The covering of bristles 3 may vary in a pattern in the geometric configuration of said bristles in their end portions which are remote from said backing.

I claim:

1. An apparatus for needling a non-woven web, comprising (a) reversing pulleys and (b) a brush-like piercable support comprising an endless backing trained around the pulleys and an outside covering of bristles spaced from each other protruding from the backing to an elevation thereabove, wherein (c) the spacing of the bristles in said covering varies according to a desired pattern of the non-woven web.

2. The needling apparatus of claim 1, wherein the elevation of the bristles in said covering also varies according to the desired pattern.

3. An apparatus for needling a non-woven web, comprising (a) reversing pulleys and (b) a brush-like piercable support comprising an endless backing trained around the pulleys and an outside covering of bristles protruding from the backing and having end portions remote from the backing, wherein (c) at least the end portions of the bristles in said covering have transverse cross-sections varying according to a desired pattern of the non-woven web.

4. The apparatus of claim 3, wherein the bristles in the covering protrude to an elevation varying according to the described pattern.

5. A brush-like piercable support for use in an apparatus for needling a non-woven web, the apparatus comprising reversing pulleys and the support comprising an endless backing trained around the pulleys and an outside covering of bristles spaced from each other and protruding from the backing to an elevation thereabove, wherein the spacing of the bristles in said covering varies according to a desired pattern of the non-woven web.

6. The needling apparatus of claim 5, wherein the elevation of the bristles in said covering also varies according to the desired pattern.

7. A brush-like piercable support for use in an apparatus for needling a non-woven web, the apparatus comprising reversing pulleys and the support comprising an endless backing trained around the pulleys and an outside covering of bristles protruding from the backing and having end portions remote from the backing, wherein at least the end portions of the bristles in said covering have transverse cross-sections varying according to a desired pattern of the non-woven web.

8. The apparatus of claim 7, wherein the bristles in the covering protrude to an elevation varying according to the desired pattern.

* * * * *